US010262524B2

(12) United States Patent
Guido

(10) Patent No.: US 10,262,524 B2
(45) Date of Patent: Apr. 16, 2019

(54) PERSONAL SECURITY WHISTLE APPARATUS

(71) Applicant: Paul A Guido, Jensen Beach, FL (US)

(72) Inventor: Paul A Guido, Jensen Beach, FL (US)

( * ) Notice: Subject to any disclaimer, the term of this patent is extended or adjusted under 35 U.S.C. 154(b) by 0 days.

(21) Appl. No.: 16/001,507

(22) Filed: Jun. 6, 2018

(65) Prior Publication Data

US 2018/0286217 A1 Oct. 4, 2018

Related U.S. Application Data

(63) Continuation-in-part of application No. 29/578,764, filed on Sep. 23, 2016.

(51) Int. Cl.

| | |
|---|---|
| ***G08B 25/12*** | (2006.01) |
| ***G08B 21/08*** | (2006.01) |
| ***G08B 17/06*** | (2006.01) |
| ***G10K 5/00*** | (2006.01) |
| ***G08B 3/10*** | (2006.01) |
| *G08B 25/10* | (2006.01) |

(52) U.S. Cl.

CPC ..... *G08B 25/12* (2013.01); *G08B 3/10* (2013.01); *G08B 17/06* (2013.01); *G08B 21/088* (2013.01); *G10K 5/00* (2013.01); *G08B 25/10* (2013.01)

(58) Field of Classification Search

CPC ..... G08B 25/12
USPC ..... 340/573.6
See application file for complete search history.

(56) References Cited

U.S. PATENT DOCUMENTS

| | | | | |
|---|---|---|---|---|
| 5,826,534 | A * | 10/1998 | Huang | G10K 5/00 116/137 R |
| 6,582,097 | B2 * | 6/2003 | Chang | A44B 15/005 362/196 |
| 6,698,377 | B1 * | 3/2004 | Topman | A01K 15/02 116/137 R |
| 6,942,362 | B1 * | 9/2005 | Deutsch | B60Q 1/326 362/116 |
| 8,424,350 | B2 * | 4/2013 | Bernatchez | A44B 15/00 70/456 R |
| 2005/0237736 | A1 * | 10/2005 | Wimsatt | A44B 15/005 362/196 |
| 2006/0180073 | A1 * | 8/2006 | Nakamoto | G10K 5/00 116/200 |
| 2009/0270751 | A1 * | 10/2009 | Peng | A61B 5/0873 600/538 |

(Continued)

FOREIGN PATENT DOCUMENTS

| | | | |
|---|---|---|---|
| CN | 205901889 U | * | 1/2017 |
| JP | 2006235777 A | * | 9/2006 |

*Primary Examiner* — Eric Blount
(74) *Attorney, Agent, or Firm* — Dale J. Ream

(57) ABSTRACT

A personal security apparatus includes an electronic device that includes a housing having a front wall, a rear wall, and a side wall extending between peripheral edges of the front wall and the rear wall, respectively, the housing defining an interior area. A whistle assembly operably situated on the housing that includes a slit defined by the front wall of the housing, the slit being displaced from and proximate to the side wall of the housing. The personal security apparatus includes a battery positioned in the interior area of the housing and an audible alarm electrically connected to the battery. An input member, such as a panic button, is positioned on one of the front wall or the rear wall of the housing and electrically connected to the audible alarm for energizing the audio alarm when actuated.

11 Claims, 7 Drawing Sheets

(56) References Cited

U.S. PATENT DOCUMENTS

2016/0314678 A1* 10/2016 Hsieh ..... G10K 5/00

* cited by examiner

PERSONAL SECURITY WHISTLE APPARATUS

REFERENCE TO RELATED APPLICATIONS

This application claims the priority and benefit of U.S. Ser. No. 29/578,764 filed Sep. 23, 2016 titled SECURITY WHISTLE AND ALARM which is incorporated in its entirety herein by reference.

BACKGROUND OF THE INVENTION

This invention relates generally to personal security devices and, more particularly, to a security whistle having an electronic alarm, remote signaling, geographic location tracking, and detection of dangerous environmental conditions.

One of the oldest, trusted, and effective personal security devices is a non-electronic whistle, such as a police whistle. Before the advent of car alarms and other electronic security devices, an individual could rely on a basic police whistle or a referee's whistle such is used at a football or basketball game. Such a whistle, when blown into, can produce greater than 100 decibels of a shrill sound that is effective to attract attention and indicate something is going on. Even so, electronic alarms are also effective and desirable, especially for use by persons for whom blowing the whistle is difficult or insufficient. Still further, an individual may find herself in dangerous water or heat situations and, as a result, has a desired to contact police or other parties of the dangerous conditions and a rapid need for assistance or rescue.

Various devices are known in the art or have been proposed in the prior patents for personal security devices. While presumably effective for their intended purposes, the existing devices do not provide a wearable device having the simplicity of a police whistle in combination with an audible electronic alarm, transmission of security signals including global position data and also with detection of dangerous water and temperature environments indicative of an emergency situation.

Therefore, it would be desirable to have a wearable personal security device that eliminates the disadvantages of prior and current personal security devices and satisfies the objects and advantages described in the present disclosure.

SUMMARY OF THE INVENTION

A personal security apparatus according to the present invention includes an electronic device that includes a housing having a front wall opposed to a rear wall and having a side wall extending between peripheral edges of the front wall and rear wall, respectively, the housing defining an interior area. A whistle assembly is situated on the housing that includes a slit defined by the front wall of the housing, the slit being displaced from and proximate to the side wall of the housing. The personal security apparatus includes a battery positioned in the interior area of the housing and an audible alarm electrically connected to the battery. An input member, such as a panic button, is positioned on one of the front wall or the rear wall of the housing and electrically connected to the audible alarm for energizing the audio alarm when actuated.

Therefore, a general object of this invention is to provide a personal security device that is wearable about the neck or wrist of a person and enables a user to garner the attention of persons both close by and distantly remote from the user if dangerous conditions are indicated.

Another object of this invention is to provide a personable security device, as aforesaid, that tracks the position of a user and transmits that position to authorities, parents, or the like if a panic button is pressed or other dangerous conditions are detected.

Still another object of this invention is to provide a personable security device, as aforesaid, that is waterproof, has a surface conducive to fingerprint detection, detects immersion in water, and detects conditions indicative of a fire or other rapid temperature increases.

Yet another object of this invention is to provide a personable security device, as aforesaid, that is easy to wear, store, and operate.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Figure 1A:
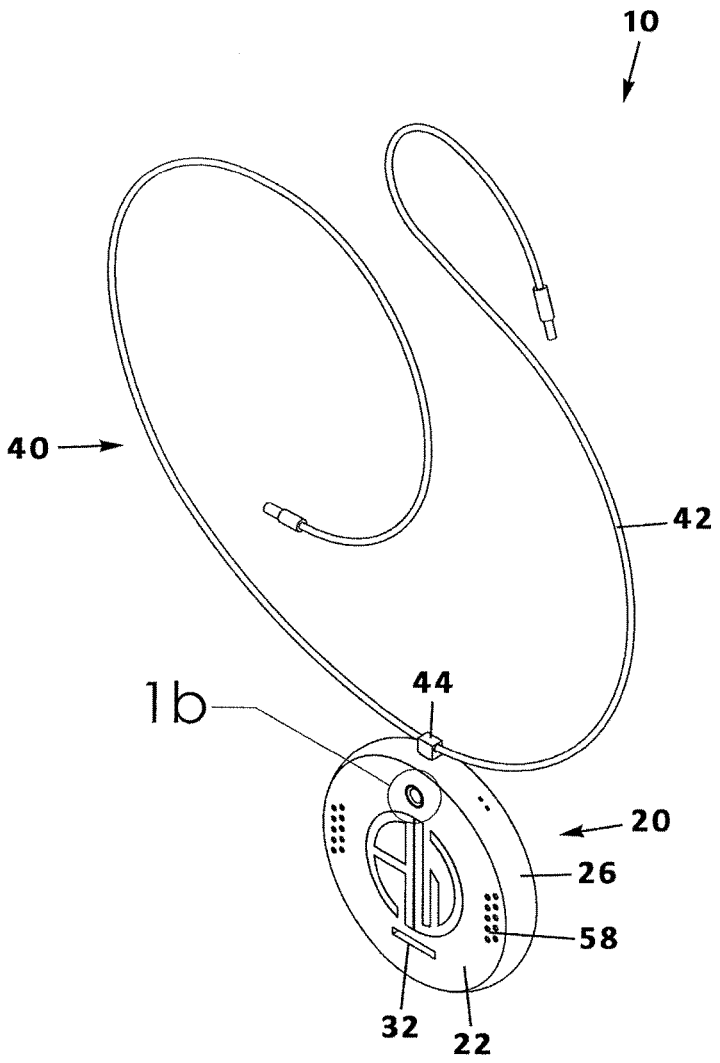
FIG. 1*a* is a perspective view of a personal security whistle apparatus according to a preferred embodiment of the present invention in use mounted to a necklace.
Figure 1B:
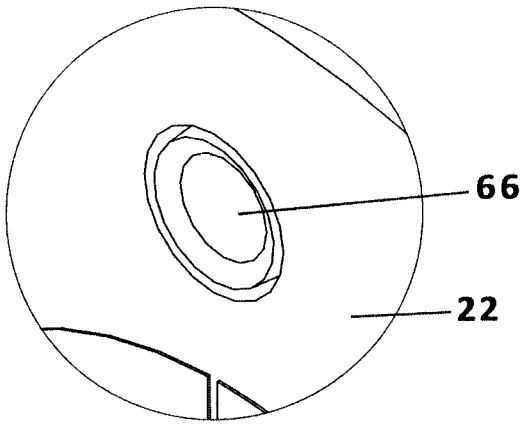
FIG. 1*b* is an isolated view on an enlarged scale taken from FIG. 1*a;*
Figure 2A:
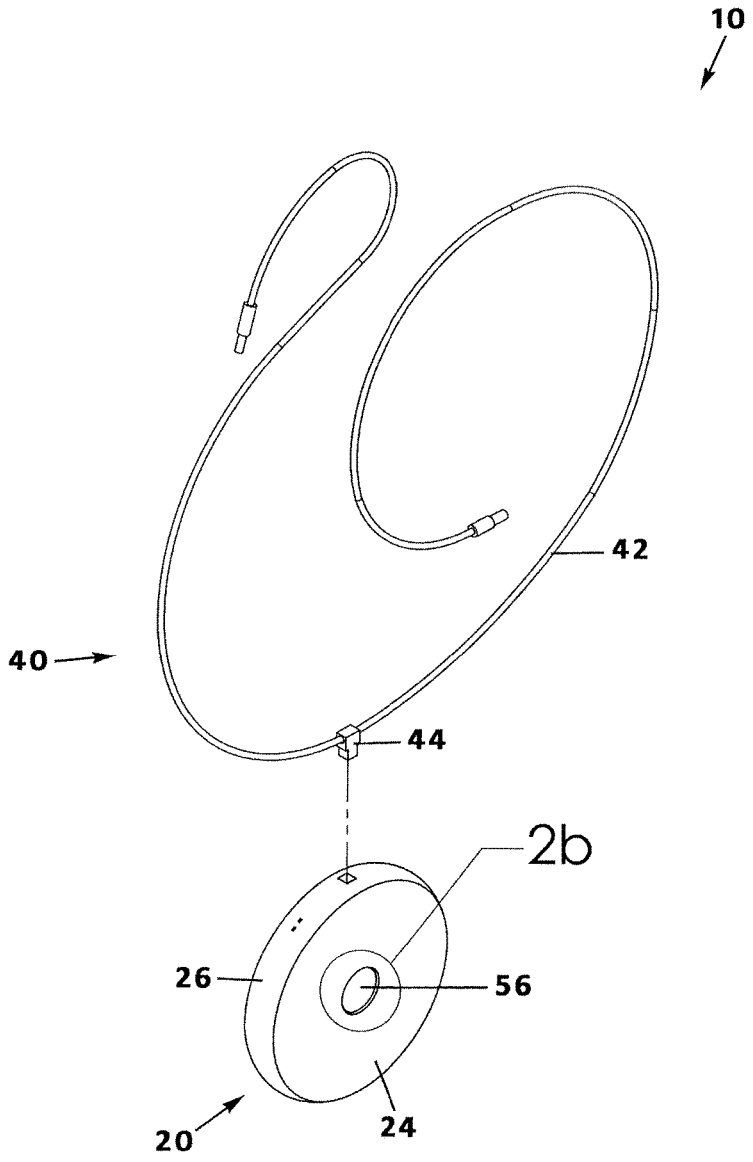
FIG. 2*a* is a perspective view from a reverse angle of the personal security whistle apparatus as in FIG. 1*a;*
Figure 2B:
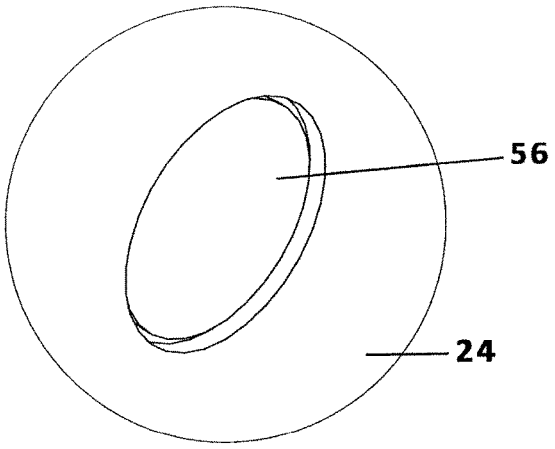
FIG. 2*b* is an isolated view on an enlarged scale taken from FIG. 2*a;*
Figure 3A:
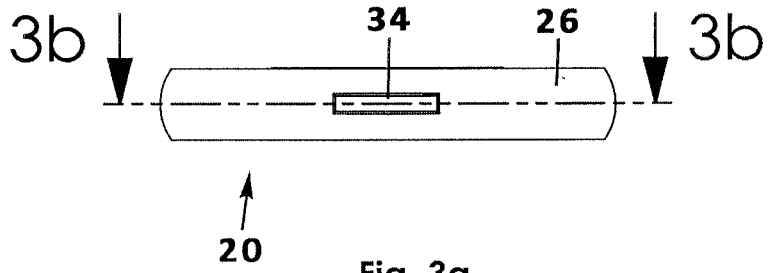
FIG. 3*a* is a side view taken from a bottom angle of the personal security whistle apparatus of FIG. 1.
Figure 3B:
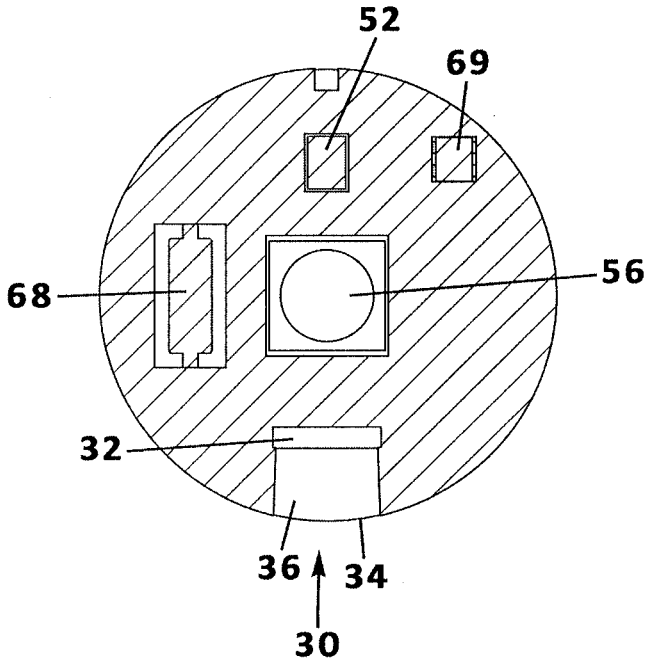
FIG. 3*b* is a sectional view taken along line 3b-3b of FIG. 3*a*.

A personal security apparatus according to a preferred embodiment of the present invention will now be described with reference to FIGS. 1 to 5 of the accompanying drawings. The personal security apparatus 10 includes an electronic device having a housing 20, a whistle assembly 30, a tether 40, and electronic components situated in an interior area defined by the housing 20.

The personal security apparatus 10 includes an electronic device having a housing 20 specifically configured to be selectively secured and retained on the body of a person. In general, the electronic device is operable to detect numerous conditions indicative of potential danger to the health and safety of the person who is wearing the electronic device, such as about her neck, on her wrist, or the like as will be described in more detail below.

The housing 20 includes at least a front wall 22, a rear wall 24 opposite and displaced from the front wall 22, and a continuous side wall 26 extending between peripheral edges of the front and rear walls, respectively. Together, the front, rear, and side walls of the housing 20 define an interior area having a size sufficient to contain the electronic components described later. In an embodiment, the front wall 22 and rear wall 24 are constructed of a material having a planar or slick surface that is suitable for picking up fingerprints of any person who touches it. For instance, if a perpetrator of an assault, kidnapping, or even a murder of the person wearing the personal security apparatus 10 will potentially leave fingerprints on the walls of the housing 20 which increases the likelihood of law enforcement to locate and arrest the perpetrator.

A whistle assembly 30 is mounted to the housing 20 of the personal security apparatus 10. Preferably, the whistle assembly 30 is integrally constructed in the walls of the housing 20. More particularly, the front wall 22 of the housing 20 defines a slit 32 at a position displaced from a peripheral edge of the front wall 22, i.e. displaced from the side wall 26. It is understood that in another embodiment, the slit 32 may be defined by the rear wall 24. Further, the side wall 26 may define an aperture 34 and an airflow channel 36 in fluid communication with the aperture 34 and slit 32. Accordingly, a user may blow air through aperture 34 to produce a distinctive or shrill audible sound. It is understood that a person producing a sound in this manner is likely to draw the attention of others in cases of danger and so as to solicit assistance, rescue, or protection.

In addition to the whistle assembly 30, the personal security apparatus 10 may include a battery operated alarm so as to produce an audible alert that is much louder and capable of soliciting assistance from a longer distance than actuation of the whistle assembly 30 alone is capable of. The audible alarm 54 is an electronic alarm positioned inside the interior area of the housing 20 and is electrically connected to a battery 50 also positioned in the housing 20. The audible alarm 54 includes an input member 56 electrically connected to the electronic alarm and is operable to energize the electronic alarm when actuated. In an embodiment, the input member 56 may be referred to as a "panic button" mounted on the rear wall 24 of the housing 20. The input member 56, of course, may alternatively be positioned on the front wall 22 or side wall 26 and may have an ergonomic configuration to be easily pressed by a user who is under attack or otherwise feels a need to have immediate assistance of rescue.

The audible alarm 54 may be electrically connected to one or more speakers 58 also situated in the interior area of the housing and a wall of the housing 20 (such as a front wall) may define openings through which sound emitted by the audible alarm 54 may exit the housing 20.

The housing 20 of the electronic device may include a tether 40 configured to be selectively retained on or coupled to a person so that the personal security apparatus 10 is available to summon assistance whenever needed. In an embodiment, the tether 40 may be a necklace 42 that includes a cord having an elongate length that may be worn about the neck of a person. In this manner, the housing 20 is close by, enabling a user to bring the whistle assembly 30 to her mouth or access and depress the input member 56 (i.e. panic button). In addition, a clip 44 or other fastener may be coupled to the cord of the tether 40 and selectively and releasably coupled to the housing 20. More particularly, the side wall 26 of the housing 20 may include a complementary fastener or may define an aperture 28 (FIG. 2*a*) into which the clip 44 may be frictionally or mechanically engaged. In operation, the housing 20 may be released from the tether 40 and carried in a purse, briefcase, or laid on a table and still be accessible for use.

Figure 4:
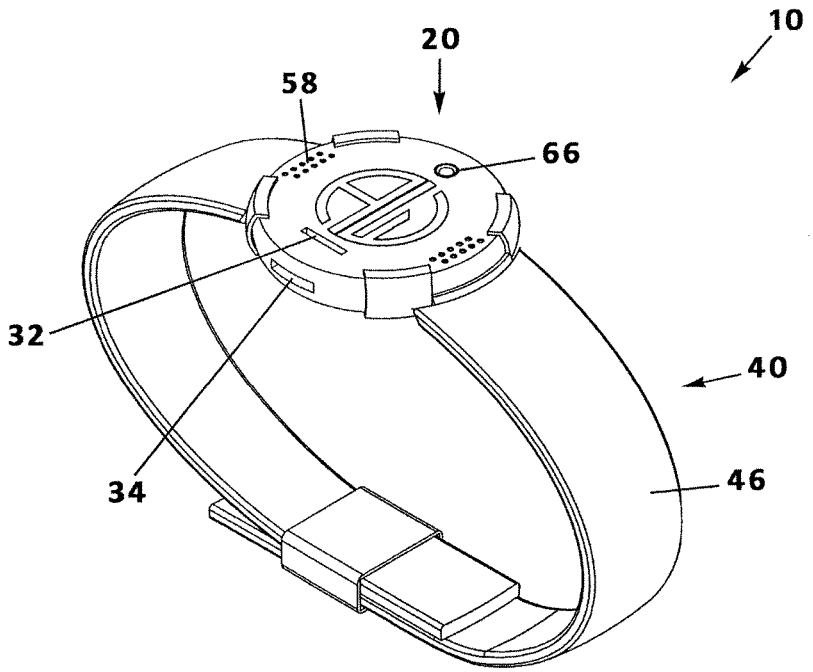
FIG. 4 is a perspective view of the personal security whistle apparatus according to the present invention in use mounted to a wristband.
Figure 5:
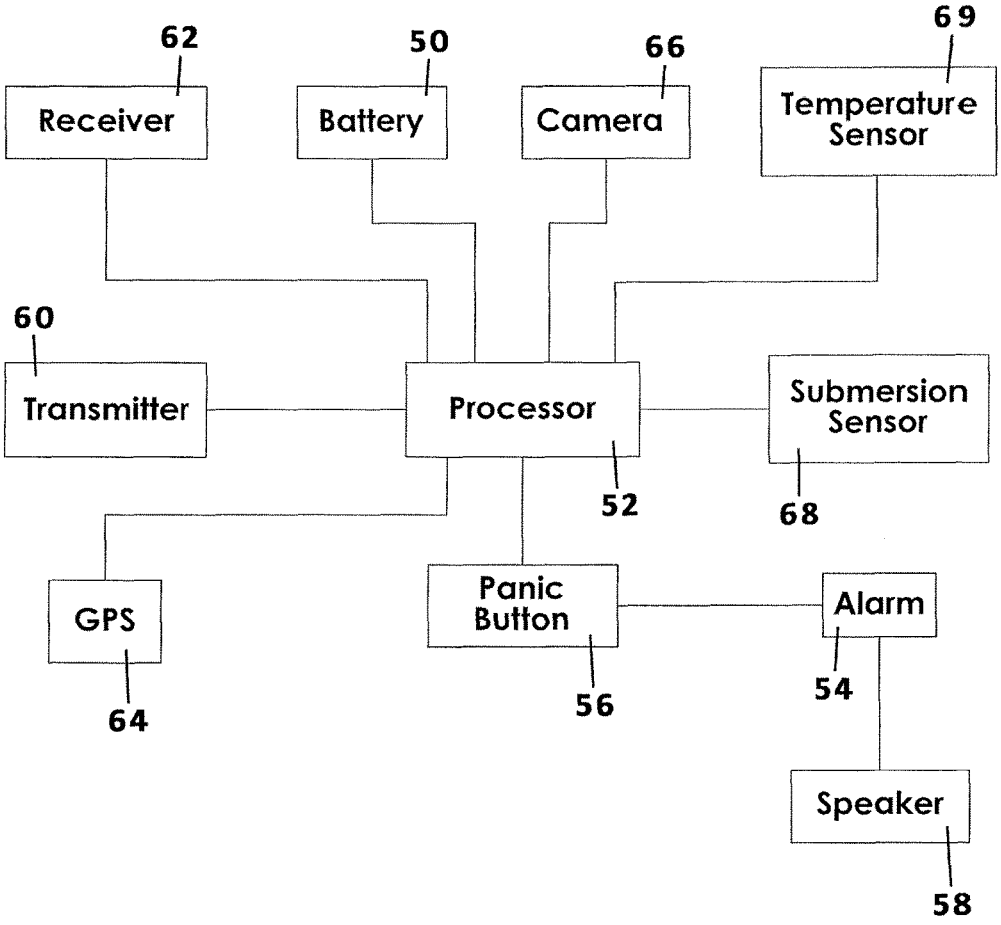
FIG. 5 is a block diagram illustrating the electronic components of the personal security whistle apparatus.

In another embodiment, the tether 40 may be a wristband 46 such that the electronic device may be attached and worn in the manner of a wristwatch. Specifically, opposed edges of the side wall 26 of the housing 20 may be coupled to respective ends of respective portions of the wristband 46 (FIG. 4). It is understood that the housing 20 remains oriented so that the aperture 28 of the whistle assembly 30 remains exposed for use as described above.

The personal security apparatus 10 may include additional electronic devices positioned inside the electronic device for imparting additional functionality as will be described below. A processor 52 may be positioned in the interior area defined by the housing 20 and is electrically connected to the battery 50. As will be described, the processor 52, which may also be referred to as a microprocessor, central processing unit, or merely as a CPU, may programmed to cause other electronic components to be energized and to carry out specific functions or to transmit data. It will be understood that the processor 52 being "programmed" or being "operable" may include the processor 52 executing programming instructions stored in a non-volatile memory (not shown) or via additional circuitry (not shown).

Next, a transmitter 60 may be mounted in the interior area of the housing and may be in data communication with the processor 52. The transmitter 60 is operable to transmit a signal through the ambient air away from the housing 20 when energized and actuated to do so by the processor 52. It is understood that the transmitter 60 may, in some embodiments, include other electronic components beyond merely a transmitter 60 operable to transmit a signal. For instance, the term "transmitter" may include a communications module configured to deliver cellular phone signals or circuitry for connecting to a network such as the internet. For instance, the processor 52 may energize the transmitter 60 and supply alert data thereto for transmission to predetermined telephone numbers or to a security authority such as 9-1-1 when the input member 56 (panic button) is pressed indicative of an alert situation.

Similarly, a global position satellite ("GPS) module 64 may be mounted in the interior area of the housing 20 and may be in data communication with the processor 52. The global position satellite ("GPS) module 64 may also be referred to as a GPS module or merely as the GPS module 64. An electronic device in communication with a plurality of global satellites, the GPS module 64 is operable to determine its own geographic position in the world and, implicitly, to determine the geographic position of the housing 20 of the electronic device of the personal security apparatus 10. The GPS module 64 is operable to generate position data indicative of its geographic position. Then, the processor 52 is operable, such as when an alert is indicated—for instance when the panic button is pressed—to cause the position data generated by the GPS module 64 to be transmitted by the transmitter 60 along with the general emergency alert described above. This way, security authorities are notified of the exact geographic position of the user that has indicated (or solicited) emergency assistance.

Further, a camera 66 may be mounted on the front wall 22 of the housing 20 and may be in data communication with the processor 52. The camera 66 is operable to take a picture or even video when actuated and to generate image data accordingly. It will be understood that the camera 66 may be electrically connected to the input member 56 (i.e. panic button) or may have its own input member (not shown) so that at least one but preferably multiple photographs are taken hopefully to include a picture of a perpetrator of a criminal or threatening act. The processor 52 is operable to cause the transmitter 60 to transmit the image data along with the alert data or position data as described above.

Similarly, a water immersion sensor 68 may be mounted in the interior area of the housing 20 and may be in data communication with the processor 52. The immersion sensor is operable to detect if the sensor is immersed under water and indicative that the personal security device itself (and presumably a person wearing it) is submerged in water. Unfortunately, a detection of total immersion probably means that the person has perhaps been assaulted and thrown into a body of water or that an automobile he or she is driving has entered a body of water. The immersion sensor 68 is operable to generate moisture data. The processor 52 is operable to cause the transmitter 60 to transmit the moisture data along with the alert data or position data as described above.

Still further, a temperature sensor 69 may be mounted in the interior area of the housing 20 and may be in data communication with the processor 52. The temperature sensor 69 is operable to detect a temperature of ambient air inside the housing 20 and to generate temperate data when actuated—such as when the input member (panic button) is actuated—or cyclically or all the time. The processor 52 is operable to cause the transmitter 60 to transmit the temperature data along with the alert data or position data as described above so that the authorities are alerted that there may be a fire event to overcome.

In addition, a receiver 62 may be mounted in the interior area of the housing 20 and may be in data communication with the processor 52. The primary function of the receiver 62 is to receive signals from remote sensors or from parties or authorities who may transmit signals to the personal security device in reply to alert signals or data transmitted by the transmitter 60 of the personal security apparatus 10. For example, law enforcement may reply to an alert transmission with a statement such as "Law Enforcement Responding . . . we'll be there in 3 minutes" so as to scare away a perpetrator or to reassure the user.

Finally, the front wall of the housing may include indicia that is indicative of the "Amber Whistle" security system. The indicia, which may be a word, graphic logo, color indica, or the like may be the first line of security and cause potential attackers to run away and not challenge the person wearing the device.

Accordingly, the personal security apparatus 10 may be worn about the neck or on the wrist of a user, such as a child or female desiring added security from potential attackers and other emergency conditions. When worn in environments where other persons are nearby, the user may blow into the whistle device to solicit help if the user's personal safety is compromised. In addition, the user may activate an electronic alarm and an alert may be transmitted if the threat continues or is elevated. Other emergency conditions are also sensed and respective data may be transmitted as described above.

It is understood that while certain forms of this invention have been illustrated and described, it is not limited thereto except insofar as such limitations are included in the following claims and allowable functional equivalents thereof.

The invention claimed is:

1. A personal security apparatus, comprising:

an electronic device that includes a housing having a front wall opposed a rear wall and having a side wall extending between peripheral edges of said front wall and said rear wall, respectively, said housing defining an interior area;

a whistle assembly operably situated on said housing that includes a slit defined by said front wall of said housing, said slit being displaced from and proximate to said side wall of said housing;

said whistle assembly including an aperture and an airflow channel defined by said side wall of said housing in fluid communication with said interior area and said slit of said housing, said whistle assembly being configured to make a shrill sound when a user blows air through said aperture;

a battery positioned in said interior area of said housing;

an audible alarm positioned in said interior area of said housing and electrically connected to said battery; and an input member positioned on one of said front wall or said rear wall of said housing and electrically connected to said audible alarm for energizing said audio alarm when actuated;

a tether coupled to said housing for retaining said housing to the user;

wherein:

said input member is a panic button electrically connected to said alarm;

said personal security apparatus includes a speaker positioned in said interior area of said housing and electrically connected to said alarm;

one of said front wall or said rear wall of said housing defines at least one opening in communication with said speaker;

a processor positioned in said interior space of said housing and electrically connected to said battery;

a transmitter positioned in said interior space of said housing and in data communication with said processor, said processor being programmed to energize said transmitter to transmit an alert to predetermined telephone numbers when said panic button is actuated;

an immersion sensor positioned in said interior area of said housing and operable to detect if said electronic device is submerged in water and to generate moisture data indicative of a submerged condition, said immersion sensor being in data communication with said processor;

wherein said processor is programmed to cause said submerged condition data to be transmitted by said transmitter when said alert is transmitted.

2. The personal security apparatus as in claim 1, wherein:

said tether is a necklace having an elongate cord and a clip coupled to said cord;

said side wall of said housing includes a coupling for releasably engaging said clip.

3. A personal security apparatus, comprising:

an electronic device that includes a housing having a front wall opposed a rear wall and having a side wall extending between peripheral edges of said front wall and said rear wall, respectively, said housing defining an interior area;

a whistle assembly operably situated on said housing that includes a slit defined by said front wall of said housing, said slit being displaced from and proximate to said side wall of said housing;

said whistle assembly including an aperture and an airflow channel defined by said side wall of said housing in fluid communication with said interior area and said slit of said housing, said whistle assembly being configured to make a shrill sound when a user blows air through said aperture;

a battery positioned in said interior area of said housing;

an audible alarm positioned in said interior area of said housing and electrically connected to said battery; and an input member positioned on one of said front wall or said rear wall of said housing and electrically connected to said audible alarm for energizing said audio alarm when actuated;

a tether coupled to said housing for retaining said housing to the user;

wherein:

said tether is a wristband;

opposed edges of said side wall of said housing are coupled to ends of said wristband.

4. The personal security apparatus as in 1, further comprising:

a global position satellite (GPS) module positioned in said interior area of said housing and is operable to produce position data indicative of a geographic position of said electronic device;

wherein said GPS module is in data communication with said processor, said processor being programmed to cause said position data to be transmitted by said transmitter when said alert is transmitted.

5. The personal security apparatus as in 1, further comprising:

a camera positioned on said front wall of said housing and in data communication with said processor and said transmitter, said camera being operable to generate image data when energized;

wherein said processor is programmed to cause said image data to be transmitted by said transmitter when said alert is transmitted.

6. The personal security apparatus as in 1, further comprising:

a temperature sensor positioned in said interior area of said housing and in data communication with said processor, said temperature sensor being operable to detect a temperature of ambient air and to generate temperature data and an fire alert signal if said temperature of the ambient air is indicative of a fire event;

wherein said processor is programmed to cause said temperature data to be transmitted by said transmitter when said fire alert signal is generated.

7. The personal security apparatus as in 1, further comprising a receiver in data communication with said processor, said receiver operable to receive signals from remote sensors.

8. A personal security apparatus, comprising:

an electronic device that includes a housing having a front wall opposed a rear wall and having a side wall extending between peripheral edges of said front wall and said rear wall, respectively, said housing defining an interior area;

a whistle assembly operably situated on said housing that includes a slit defined by said front wall of said housing, said slit being displaced from and proximate to said side wall of said housing;

said whistle assembly including an aperture and an airflow channel defined by said side wall of said housing in fluid communication with said interior area and said slit of said housing, said whistle assembly being configured to make a shrill sound when a user blows air through said aperture;

a battery positioned in said interior area of said housing;

an audible alarm positioned in said interior area of said housing and electrically connected to said battery; and an input member positioned on one of said front wall or said rear wall of said housing and electrically connected to said audible alarm for energizing said audio alarm when actuated;

a processor positioned in said interior space of said housing and electrically connected to said battery;

a transmitter positioned in said interior space of said housing and in data communication with said processor, said processor being programmed to energize said transmit to transmit an alert to predetermined telephone numbers when said panic button is actuated;

a necklace having an elongate cord and a clip coupled to said cord;

said housing includes a coupling for releasably engaging said clip;

an immersion sensor positioned in said interior area of said housing and operable to detect if said electronic device is submerged in water and to generate moisture data indicative of a submerged condition, said immersion sensor being in data communication with said processor;

wherein said processor is programmed to cause said submerged condition data to be transmitted by said transmitter when said alert is transmitted;

a camera positioned on said front wall of said housing and in data communication with said processor and said transmitter, said camera being operable to generate image data when energized;

wherein said processor is programmed to cause said image data to be transmitted by said transmitter when said alert is transmitted;

a global position satellite (GPS) module positioned in said interior area of said housing and is operable to produce position data indicative of a geographic position of said electronic device;

wherein said GPS module is in data communication with said processor, said processor being programmed to cause said position data to be transmitted by said transmitter when said alert is transmitted.

9. The personal security apparatus as in claim 8, wherein:

said input member is a panic button electrically connected to said alarm;

said personal security apparatus includes a speaker positioned in said interior area of said housing and electrically connected to said alarm;

one of said front wall or said rear wall of said housing defines at least one opening in communication with said speaker.

10. The personal security apparatus as in claim 8, further comprising:

a temperature sensor positioned in said interior area of said housing and in data communication with said processor, said temperature sensor being operable to detect a temperature of ambient air and to generate temperature data and a fire alert signal if said temperature of the ambient air is indicative of a fire event;

wherein said processor is programmed to cause said temperature data to be transmitted by said transmitter when said fire alert signal is generated.

11. The personal security apparatus as in claim 8, further comprising a receiver in data communication with said processor, said receiver operable to receive signals from remote sensors.

* * * * *